United States Patent [19]

Councilman et al.

[11] 4,180,724

[45] Dec. 25, 1979

[54] SOLID STATE DIGITAL RUNNING TIME INDICATOR

[75] Inventors: Clyde L. Councilman; Harry D. Shearer, both of St. Petersburg, Fla.

[73] Assignee: E-Systems, Inc., Dallas, Tex.

[21] Appl. No.: 892,129

[22] Filed: Mar. 31, 1978

[51] Int. Cl.[2] ..... G07C 1/02

[52] U.S. Cl. ..... 235/92 T; 235/92 FP; 324/186; 58/24 A

[58] Field of Search ..... 235/92 PD, 92 T, 92 FP, 235/92 EA, 92 DP; 58/23 BA, 24 A, 152 H; 324/181, 186

[56] References Cited

U.S. PATENT DOCUMENTS

| | | | |
|---|---|---|---|
| 3,793,512 | 2/1974 | Lorenzen | 235/92 T |
| 3,878,371 | 4/1975 | Burke | 235/92 PD |
| 3,988,575 | 10/1976 | Guimier et al. | 235/92 R |
| 4,031,363 | 6/1977 | Freeman et al. | 235/92 T |
| 4,049,951 | 9/1977 | Baty et al. | 235/92 DP |
| 4,107,516 | 8/1978 | Huidsten | 235/92 FP |

*Primary Examiner*—Joseph M. Thesz
*Attorney, Agent, or Firm*—Robert V. Wilder

[57] ABSTRACT

A solid state digital running time indicator is energized from the same power source supplying energy to a monitored event. A device for detecting when the power is on initiates a signal to timing circuitry for generating clock pulse signals and control timing signals. In response to an initial timing signal, a memory element reads the information from memory into a counter chain. The clock pulse signals are applied to the counter chain for counting up in predetermined increments of time from the number that is initially loaded into the counter chain from the memory element. Control circuitry writes the contents of the counter chain into the memory element after each predetermined increment of time. The total accumulated running time present in the counter chain is applied to drive and display circuitry for providing a visual indication of the running time of the event being monitored.

16 Claims, 2 Drawing Figures

SOLID STATE DIGITAL RUNNING TIME INDICATOR

FIELD OF THE INVENTION

This invention relates to running time indicators, and more particularly to a solid state digital running time indicator which includes a memory element capable of maintaining the information written into memory during power interrupt.

DESCRIPTION OF THE PRIOR ART

Running time indicators are commonly used to measure the running or elapsed time of a monitored event, e.g., the operating time for a piece of equipment such as an electrical motor. Such an indication of the elapsed or running time for a piece of equipment may provide a record of the reliability of the equipment being monitored, indicating how long a piece of equipment may operate before a problem develops in the equipment. Such indicators may also be used to indicate when the monitored equipment is due for some periodic maintenance.

Present running time indicators are of two basic types operating according to either electromechanical or microcoulometer principles. Both types of existing running time indicators possess certain inherent disadvantages, such as the limitations of using mechanical parts, imprecise recording of time and unreliability. The concept of the present solid state digital running time indicator overcomes such problems and additionally makes it possible for one indicator to monitor the running time of a plurality of phenomena or events. The running time indicator of the present invention has no heaters and no mechanical moving parts to wear out and its solid state construction provides for more accurate recording of time and improved reliability. In addition, the solid state digital running time indicator can monitor a plurality of phenomena or events alternately or simultaneously, depending on the amount and organization of the memory element.

SUMMARY OF THE INVENTION

The present invention provides a running time indicator utilizing solid state semiconductor devices and offering improved accuracy and reliability along with the additional capability of monitoring a plurality of phenomena or events.

In accordance with the present invention, an electrically energizable solid state running time indicator accumulates and stores for outputting the total running time of a monitored event. The indicator is simultaneously energized with said monitored event. A power on detector enables a timing circuit which generates a clock pulse signal and applies it to a counter chain. The counter chain accumulates the total running time the monitored event is energized, and it is counted up in increments of time determined by the frequency of the clock pulse signal. A memory element is provided for storing the total running time of the monitored event, and the memory element retains the stored information whenever the indicator is de-energized. Control circuitry is provided for initially loading the number stored in the memory element into the counter chain in response to a signal from the timing circuitry. The control circuitry includes means for writing the total running time in the counter chain into memory after each predetermined increment of time. Finally, means are provided for outputting the total running time for the monitored event.

Also in accordance with the invention, the memory element may comprise an electrically alterable read only memory (EAROM) for storing the total running time appearing in the counter chain during energization of the indicator, said memory element having the capability of retaining information written into memory when power is interrupted to the indicator. Alternately, the memory element of the present invention may comprise a random access memory (RAM) which has a source of power independent of the power supplied to the indicator and monitored event, such that the random access memory element is energized to retain information stored therein when said indicator and monitored event are de-energized.

Further in accordance with the present invention, an electrically energizable solid state running time indicator accumulates and stores for selectively outputting the total running time of a plurality of monitored events. The indicator and monitored events are simultaneously energized, and a power on detector enables a timing circuit when the indicator and monitored events are energized. The timing circuitry generates a clock pulse signal of predetermined frequency which is applied to the counters of the monitored events. A memory element stores the total running time of the monitored events, and the memory element has the capability of retaining the stored information when the indicator is deenergized. Control circuitry loads the information stored in memory into the appropriate counters in response to an initial signal from the timing circuitry after the indicator is energized. The control circuitry also includes means for writing the total running time of each of the counters into the memory element after each increment of time the counters are counted up. Finally, means are provided for selectively outputting the total running time appearing in one of said counters.

BRIEF DESCRIPTION OF THE DRAWINGS

For a more complete understanding of the present invention and further objects and advantages thereof, reference is now made to the following description taken in conjunction with the following drawings.

DESCRIPTION OF THE PREFERRED EMBODIMENT

Figure 1:
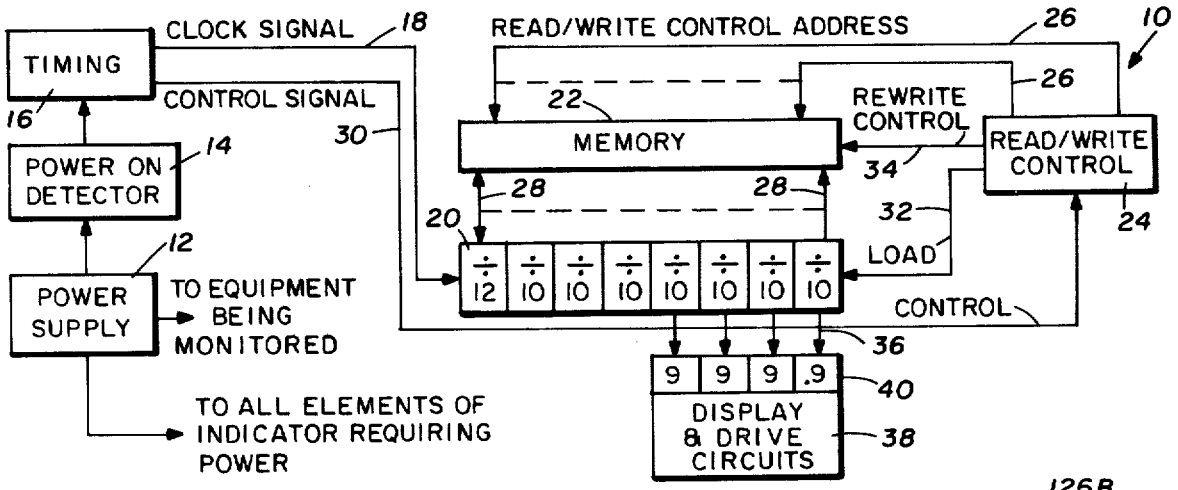
FIG. 1 is a block diagram view of the preferred embodiment of the present invention.

FIG. 1 is a block diagram view of the circuitry of the preferred embodiment of a solid state digital running time indicator, generally indicated by the numeral 10. A common power supply source 12 energizes the circuitry of the indicator 10 as well as the equipment being monitored (not shown). The energization of the common power supply 12 is applied to a power on detector 14 which enables timing circuitry 16.

The timing circuitry 16 generates a clock pulse signal 18 to a counter chain 20 for counting up in predetermined increments of time determined by the frequency of the signal 18. In FIG. 1, clock signal 18 of $3\frac{1}{3}$ Hz is applied to the counter chain 20, comprising an initial divide-by-twelve counter followed by seven decade counters for counting up said counter chain 20 approximately every 0.3 of a second to accumulate the running time for the monitored event. The counter chain 20 has the capacity to accumulate running time up to 999.9 hours. It is to be understood, of course, that additional decade counters could be provided to increase the storage capacity of the accumulators up to any desired maximum period. Likewise, the counter chain 20 may be pulsed by a clock pulse 18 of any desired frequency to provide any predetermined increment of time for measuring the running time of the monitored event.

A solid state semiconductor memory element 22 is provided for storing the total running time of the monitored event. The contents of the memory element 22 are altered by the read/write control circuitry 24 through a plurality of address lines 26. The two address lines 26 shown are representative of the plurality of address lines 26 connecting each memory cell of the memory element 22 to the read/write control circuitry 24. The individual memory cells of the memory element 22 are further connected by counter address lines 28 to the corresponding counters of the counter chain 20.

The memory element 22 is a nonvolatile solid state semiconductor memory device, wherein information stored in the memory device is not lost when external power is removed. The memory element 22 shown in FIG. 1 of the running time indicator 10 is an electrically alterable read only memory (EAROM), which can be altered without the necessity of erasing the entire array. Existing EAROM's may maintain the information in memory for up to ten years after being de-energized. The memory cells of the EAROM used as a memory element 22 in the running time indicator 10 of the present invention may be selectively altered by the read/write control circuitry 24 by loading the updated contents of the counter chain 20 into the memory element 22. Thus, an EAROM is ideally suited for use as the nonvolatile memory element 22 to retain the running time of the monitored event when external power is removed from the indicator 10.

Although an EAROM has been described as a suitable solid state semiconductor device to be used as the memory element 22, there are, of course, other solid state semiconductor devices which may also be used for the memory element 22. For example, a random access memory (RAM) semiconductor device may be employed with a source of external power independent of the power supply to the running time indicator 10 and the monitored event. The RAM memory device may be electrically altered by writing the information from the counter chain 20 into the RAM memory device. With a separate source of external power, such as a battery, the information stored in the RAM remains in memory when the external power to indicator 10 is interrupted. Other forms of memory could also be used in the solid state semiconductor running time indicator, including magnetic memory.

The timing circuitry 16 applies a control signal 30 to the read/write control circuitry 24 in response to the initial and each succeeding clock pulse signal 18 generated by said timing circuitry 16. In response to the initial signal from the timing circuitry 16, the read/write control circuitry 24 causes a load signal 32 to be applied to the counter chain 20, loading the contents of the memory element 22 into the corresponding counters of the counter chain 20 through the counter address lines 28. Read/write control circuitry 24 could also include a reset switch for resetting the cumulative total in memory element 22 to zero to enable the indicator 10 to be reused.

In addition, the read/write control circuitry 24 applies a rewrite control signal 34 to the memory element 22 after each increment of time the counters of counter chain 20 are counted up. The number in each of the counters of the counter chain 20 is applied through counter address lines 28 to the corresponding memory cells of the memory element 22. Thus, the read/write control circuitry 24 provides for the initial loading of the number last stored in the memory element 22 to be placed into the counter chain 20 to maintain the cumulative running time of the monitored event. The memory element 22 is thus continually updated with the number in the counter chain 20.

The accumulated running time of the monitored equipment stored in the four most significant counters of the counter chain 20 are applied through display lines 36 to display and drive circuitry 38 and digital display element 40 for providing a visual display of the four most significant digits. The running time indicator 10 shown in FIG. 1 displays the running time for the monitored piece of equipment up to 999.9 hours. The digital display element 40 may comprise any of the well known digital displays, such as light emitting diodes (LED), liquid crystal display elements and gas discharge or plasma displays.

Figure 2:
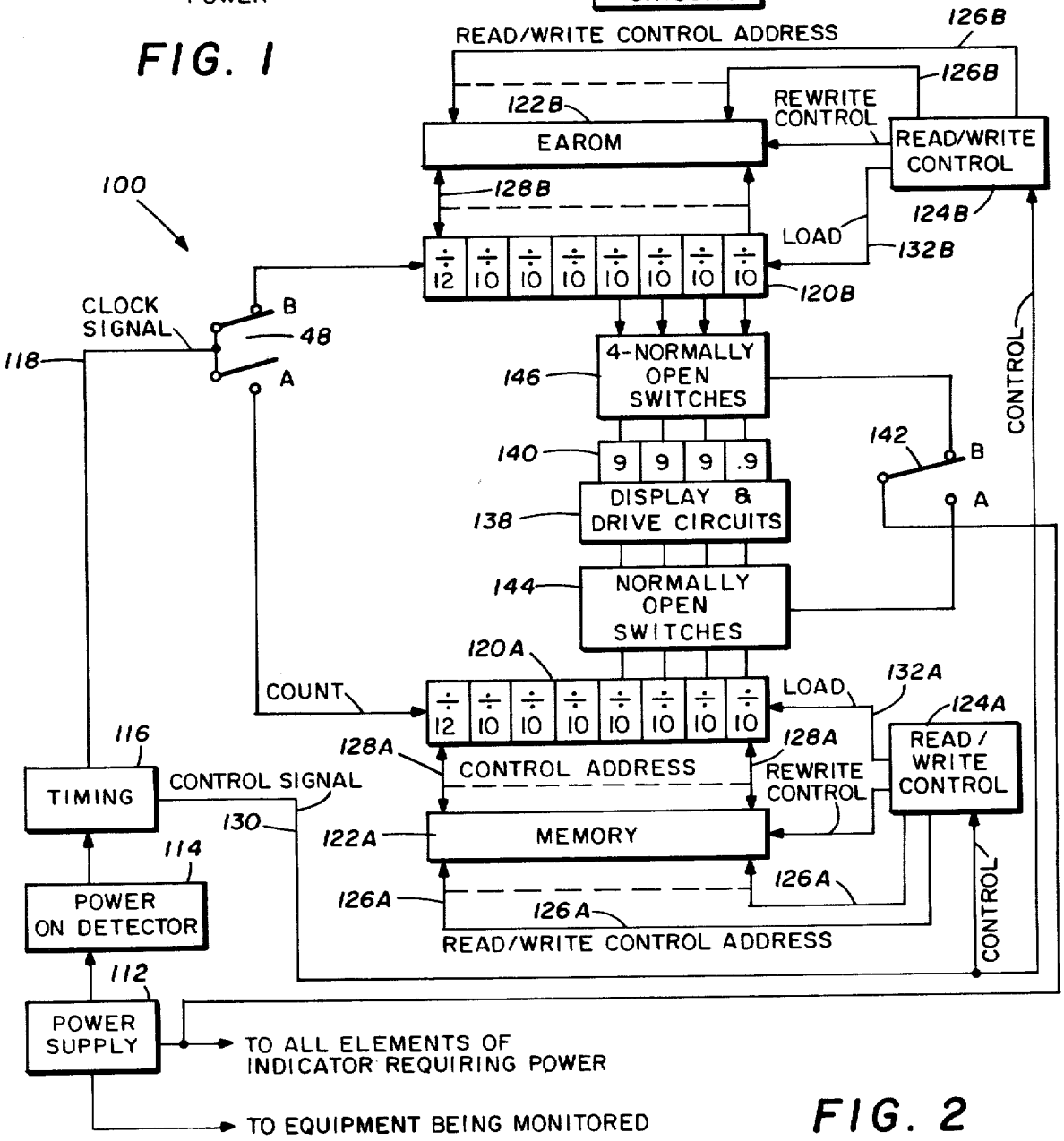
FIG. 2 is a block diagram for an alternate embodiment of the present invention.

FIG. 2 is a block diagram of an alternate embodiment of a solid state semiconductor digital running time indicator, generally referenced by the numeral 100. The running time indicator 100 may be used for selectively monitoring either one or both of two events. Of course, the alternate embodiment could be modified to monitor any number and desired combination of events. Running time indicator 100 has elements which correspond to similar elements in the running time indicator 10, and are identified by the same reference numeral previously used but increased by 100. The elements of the running time indicator 100 which correspond to the first monitored event are identified by the addition of the letter "A" to the reference numeral, and the elements which correspond to the second monitored event are identified by the addition of the letter "B".

The power supply 112 simultaneously energizes the running time indicator 100 as well as the monitored events. Upon energization of the power supply 112, power on detector 114 enables the timing circuitry 116. The energization of the power supply 112 also provides a signal through a display switch 142 to close either the normally open switches 144 for the first monitored event "A" or normally open switches 146 for the second monitored event "B". The display switch 142 is thus used to select counter 120A or 120B for display through display and drive circuitry 138 and display 140. Switch 142 is illustrated in FIG. 2 to display the cumulative running time for the monitored event "B".

The timing circuitry 116 applies a control signal 130 to the read/write control circuitry 124A and 124B to place the contents of the memory elements 122A and 122B into the corresponding counter chains 120A and 120B in a manner similar to that described above for indicator 10. Timing circuitry 116 also applies a clock pulse signal 118 through an event select switch 148 for selectively applying the clock signal 118 to either counter 120A or 120B. The switch 148 shown in FIG. 2 is two normally open switches for applying the clock pulse signal 118 to either the counter chain 120B, counter chain 120A, or both. When the switch 148 is closed as indicated in FIG. 2, the number stored in the counter chain 120B is then displayed in the digital display element 140 in the manner described above. The number in the counter chain 120B is written into the memory element 122B after each clock pulse signal 118 in a manner similar to that described above for memory element 22.

The solid state digital running time indicator 100 shown in FIG. 2 and described above is adapted for use where a common power supply is used and where only one or the other of two monitored events is energized. Such an arrangement would be suitable for use, for example, in monitoring the running time of a transmitter and receiver operating in the simplex mode. However, many variations in the running time indicator 100 are possible for monitoring the simultaneous operation of two monitored events. If two monitored events were both operated and monitored simultaneously, event select swisch 148 could comprise two normally open switches, wherein both switches could be closed simultaneously for monitoring both events. As long as the same power supply is used to monitor both events, the change in switch 148 would be the only change necessary as long as there was a common power source. Thus, with such a modification to switch 148 the indicator 100 illustrated in FIG. 2 could simultaneously monitor the running time of more than one event, such as the duplex operation of a transmitter and receiver.

If different power supplies were used to energize the monitored events, some modification of the circuitry would be necessary to detect when each of the monitored events was energized. One running time indicator 100 could then be used to monitor completely unrelated events. In the situation where the running time indicator 100 is used to monitor more than one event, each of the counter chains 120 accumulating running time for the monitored event may address a single memory element 122, rather than the separate elements 122A and 122B as illustrated in FIG. 2. The use of one or more memory elements to store accumulated running time depends on the amount and organization of memory.

Although preferred embodiments of the invention have been illustrated in accompanied drawings and described in the foregoing detailed description, it will be understood that the invention is not limited to the the embodiments disclosed; they are capable of numerous rearrangements, modifications and substitutions of parts and elements without departing from the spirit of the invention. What is claimed is:

1. An electrically energizable solid state running time indicator for accumulating and storing for outputting the total time a monitored event is energized, comprising;

means for simultaneously energizing said indicator and said monitored event;

means for detecting the energization of said indicator and said monitored event;

means for enabling a timing circuit in response to said detecting means indicating the energization of said indicator and said monitored event;

said timing circuit including means for generating a clock pulse signal of predetermined constant frequency;

counters for counting up the clock pulse signals generated by said timing circuitry and applied to said counters for accumulating the time said monitored event is energized, the contents of said counters corresponding to the total running time said monitored event is energized;

memory means interconnected with said counters for storing the total running time said monitored event is energized, said memory means having the capability of retaining stored information when the running time indicator is de-energized;

control circuitry for initially loading the accumulated running time stored in said memory means into said counters in response to a signal generated by said timing circuitry when said indicator is initially energized;

said control circuitry including means for writing the total running time from said counter into said memory means after each predetermined increment of time measured by said predetermined clock pulse signal for continually updating said memory means with the current accumulated running time of the monitored event; and means for outputting the total running time in said counters when said indicator is energized.

2. The electrically energizable running time indicator of claim 1, wherein said memory means comprises an electrically alterable read only memory solid state semiconductor device for storing the accumulated running time said monitored event is energized, said electrically alterable read only memory having means for electrically altering the contents of said memory and including means for retaining the stored running time when de-energized.

3. The electrically energizable running time indicator of claim 1, wherein said memory means comprises a random access memory solid state semiconductor device, said random access memory having a separate source of power for energizing said random access memory when said indicator is de-energized.

4. The electrically energizable running time indicator of claim 1, wherein said control means includes means for resetting the stored running time in said memory means.

5. The electrically energizable running time indicator of claim 1, wherein said means for outputting is a visual display means.

6. The electrically energizable running time indicator of claim 5, wherein said visual display means is a light emitting diode digital display.

7. The electrically energizable running time indicator of claim 5, wherein said visual display means is a liquid crystal digital display.

8. The electrically energizable running time indicator of claim 1, wherein said timing circuitry applies a $3\frac{1}{3}$ Hz clock pulse signal to said counters, said counters include a first divide-by-twelve counter and a series of divide-by-ten counters for counting up the time in predetermined increments of time.

9. An electrically energizable solid state running time indicator for selectively accumulating and storing for outputting the total elapsed time a plurality of monitored events are energized, comprising:

means for energizing said indicator and selected ones of said monitored events;

means for detecting the energization of said indicator and one or more of said monitored events for applying a start signal to enable timing circuitry;

said timing circuitry including means for generating a clock pulse signal of predetermined constant frequency;

counters for each of said monitored events, said counters being responsive to said clock pulse signal applied by said timing circuitry for counting up the time each of said monitored events is energized, the contents of said counters indicating the total running time of corresponding monitored events;

switching means for selectively applying said clock pulse signal to one or more of the counters corresponding to said energized events for accumulating the running time said monitored event is energized;

memory means interconnected with said counters for storing the total running time each of said monitored events is energized, said memory means having the capability of retaining the stored running time when the indicator is de-energized;

control circuitry for initially loading the running time stored in said memory means for each of said monitored events into said counters for each of said monitored events in response to a signal from said timing circuitry generated when said indicator is initially energized;

said control circuitry including means for writing the total running time in each of said counters into said memory means after each predetermined increment of time measured by said clock pulse signal for continually updating said memory means with the current accumulated running time of the monitored event; and means for selectively outputting the total running time appearing in each of said counters for the corresponding selected monitored events.

10. The electrically energizable running time indicator of claim 9, wherein said means for selectively outputting the total running time in each of said counters includes a visual display means.

11. The electrically energizable running time indicator of claim 10, wherein said visual display means includes a light emitting diode digital display.

12. The electrically energizable running time indicator of claim 10, wherein said visual display means includes a liquid crystal digital display.

13. The electrically energizable running time indicator of claim 9, wherein said memory means comprises a single solid state semiconductor memory device having the organization and capacity to store the running time from each of said counters for each of said monitored events.

14. The electrically energizable running time indicator of claim 9, wherein said memory means comprises an electrically alterable read only memory semiconductor device for storing the accumulated running time for said monitored events, said electrically alterable read only memory having means for electrically altering the contents of said memory and including the means for retaining the stored running time when de-energized.

15. The electrically energizable running time indicator of claim 9, wherein said memory means comprises a random access memory solid state semiconductor device, said random access memory having a separate source of power for energizing said random access memory device when said indicator is de-energized.

16. The electrically energizable running time indicator of claim 9, wherein said control means includes means for selectively resetting the running time stored in said memory means for each of said monitored events.

* * * * *